US010190306B2

(12) United States Patent
Stanaland

(10) Patent No.: US 10,190,306 B2
(45) **Date of Patent: *Jan. 29, 2019**

(54) ANTI-OSCILLATION VALVE

(71) Applicant: Jay R. Smith Manufacturing Company, Montgomery, AL (US)

(72) Inventor: William A. Stanaland, Montgomery, AL (US)

(73) Assignee: Jay R. Smith Manufacturing Company, Montgomery, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/637,695

(22) Filed: Jun. 29, 2017

(65) Prior Publication Data

US 2017/0298605 A1 Oct. 19, 2017

Related U.S. Application Data

(62) Division of application No. 14/545,559, filed on May 21, 2015, now Pat. No. 9,708,808.

(51) Int. Cl.
*E03C 1/296* (2006.01)
*E03F 5/04* (2006.01)

(52) U.S. Cl.
CPC ..... *E03F 5/041* (2013.01); *E03C 1/296* (2013.01); *E03F 5/0407* (2013.01); *Y10T 137/266* (2015.04)

(58) Field of Classification Search
CPC ..... Y10T 137/778; Y10T 137/2652; Y10T 137/266; Y10T 137/2663; E03C 1/296; E03F 5/0407; E03F 5/041
USPC ..... 62/511; 137/533.19, 493.9
See application file for complete search history.

(56) References Cited

U.S. PATENT DOCUMENTS

| | | | | | |
|---|---|---|---|---|---|
| 1,759,826 | A | | 5/1930 | Goss | |
| 1,967,644 | A | | 7/1934 | Williams | |
| 2,233,818 | A | * | 3/1941 | Matter | F16K 31/36 137/512.2 |
| 2,391,211 | A | * | 12/1945 | White | F04F 1/06 137/513.3 |
| 3,333,597 | A | * | 8/1967 | Sullivan | E03C 1/296 137/102 |
| 3,603,343 | A | * | 9/1971 | Keller | F16K 17/196 137/493.6 |
| 3,776,269 | A | * | 12/1973 | Watts | E03D 11/00 137/118.05 |
| 3,913,322 | A | * | 10/1975 | Over | F01N 3/30 123/568.11 |

(Continued)

*Primary Examiner* — William McCalister
(74) *Attorney, Agent, or Firm* — Eric J. Sosenko; Jonathan P. O'Brien; Honigman Miller Schwartz and Cohn LLP

(57) ABSTRACT

An anti-oscillation valve for and in a trap primer to restrict the flow of water from the supply line to an upper chamber of the trap primer and to facilitate the flow of water from the upper chamber to the supply line. The anti-oscillation valve having a body with a water supply bore provided therethrough. The bore includes portions defining an inlet and an outlet. First and second bore shoulders are formed in the bore. A filter screen is retained in engagement with the first bore shoulder. An anti-oscillation valve disc freely rests on the second bore shoulder and is retained between the first bore shoulder and the second bore shoulder. The anti-oscillation valve disc includes a valve disc orifice defined through and communicating the inlet with the outlet.

12 Claims, 12 Drawing Sheets

(56) References Cited

U.S. PATENT DOCUMENTS 4,000,752 A * 1/1977 Miller ..... F16K 31/143 137/118.05
4,016,904 A * 4/1977 Gordon ..... F16K 17/196 137/315.04
4,204,556 A * 5/1980 Sullivan ..... E03C 1/296 137/204
4,298,102 A * 11/1981 Nishikawa ..... B60G 15/062 137/493.9
4,497,337 A * 2/1985 Mosbrucker ..... E03F 7/00 137/118.07
4,531,543 A * 7/1985 Markley ..... F16K 15/02 137/513.3
4,726,488 A * 2/1988 Kasugai ..... B60K 15/0406 137/493.9
4,944,425 A * 7/1990 Kasugai ..... B60K 15/0406 215/271
4,946,448 A * 8/1990 Richmond ..... A61M 39/24 137/493.9
4,951,701 A * 8/1990 Boehmer ..... F02M 37/20 137/199
5,205,834 A * 4/1993 Moorehead ..... A61M 39/22 137/493.9
5,249,598 A * 10/1993 Schmidt ..... B60K 15/03519 137/493.1
5,287,877 A * 2/1994 Ackroyd ..... E03C 1/296 137/118.05
5,373,873 A * 12/1994 Miller ..... F17C 5/06 137/883
5,499,654 A * 3/1996 Shefte ..... B65D 51/16 137/493.9
5,655,567 A * 8/1997 Mikel ..... F16D 25/063 137/454.4
5,791,507 A * 8/1998 Harris ..... B60K 15/0406 220/203.26
5,893,273 A * 4/1999 Casiraghi ..... F25B 41/06 138/44
5,992,442 A * 11/1999 Urquhart ..... B65D 77/225 137/246
6,026,848 A * 2/2000 Huynh ..... F16K 17/196 137/493.1
6,152,164 A * 11/2000 Whiteside ..... E03C 1/122 137/118.05
6,209,568 B1 * 4/2001 Guarneri ..... B01J 4/008 137/209
6,250,201 B1 * 6/2001 Pagels ..... F15B 7/00 91/443
6,283,442 B1 * 9/2001 Whiteside ..... E03C 1/12 137/861
6,325,091 B1 * 12/2001 Perrott ..... E03C 1/296 137/247.25
6,364,861 B1 * 4/2002 Feith ..... A61M 5/1408 137/512.4
6,422,260 B2 7/2002 Danowski et al.
6,612,321 B1 * 9/2003 Ertle ..... B62D 5/062 137/1
6,875,343 B2 * 4/2005 Druga ..... B01D 27/103 137/493.6
6,880,598 B2 * 4/2005 Haunhorst ..... B60C 23/003 137/223
7,160,088 B2 * 1/2007 Peyton ..... F04C 29/128 418/55.1
7,240,676 B2 * 7/2007 Rutter ..... A61M 16/0468 128/202.27
7,363,940 B2 * 4/2008 Oberley ..... F25B 41/067 137/493.8
7,520,292 B2 4/2009 Weltman
7,565,915 B2 * 7/2009 Krug-Kussius ..... F16K 17/105 137/491
7,578,378 B2 * 8/2009 Gebert ..... F15B 7/00 192/109 F
7,931,452 B2 * 4/2011 Hibino ..... F04B 27/1018 137/493.9
8,057,161 B2 * 11/2011 Seidler ..... F04D 25/0613 415/146
8,286,658 B2 * 10/2012 Devall ..... B60K 15/03504 123/518
8,671,970 B2 * 3/2014 Vilendre ..... E03C 1/02 137/118.02
2001/0037826 A1 * 11/2001 Danowski ..... E03C 1/296 137/247.25
2002/0069668 A1 * 6/2002 Kreger ..... F25B 41/003 62/511
2007/0209707 A1 * 9/2007 Weltman ..... E03C 1/296 137/247.25
2007/0277880 A1 * 12/2007 Vilendre ..... E03C 1/296 137/247.25
2016/0340885 A1 * 11/2016 Stanaland ..... E03F 5/041

* cited by examiner

ANTI-OSCILLATION VALVE

CROSS REFERENCE TO RELATED APPLICATIONS

This application is a divisional of, and claims priority to, U.S. application Ser. No. 14/545,559, filed May 21, 2015, which is hereby incorporated by reference in its entirety.

BACKGROUND OF THE INVENTION

Field of the Invention

This invention relates to drain trap primers in which a gas under pressure is utilized to displace a liquid and a definite coaction exists between the gas and liquid that affects the system.

BRIEF SUMMARY OF THE INVENTION

Drain traps are essential in preventing the entry of poisonous sewer gas into buildings. Such traps are generally U-shaped portions of drain pipes which fill with water from the drain and thereby prevent passage of sewer gasses from a sewer into the drain and into the building. Unfortunately, when a drain is used only infrequently, the water in the trap tends to evaporate, thus exposing the users of the building to sewer gasses.

Trap primers periodically replenish the water level in the drain traps and prevent the drying of drain traps through evaporation. Prior art trap primers replenish the drain traps using water from a building's water supply pipe. Such primers release water to the drain traps in response to fluctuations in the pressure in the supply pipe, which result from a draw on water from the supply pipe, such as the opening a faucet or flushing a toilet.

Some prior art trap primers have chambers containing compressed air at a pressure that equilibrates with the water pressure in the supply pipe. When the water pipe pressure momentarily fluctuates, the compressed air opens a valve which allows water to flow from the trap primer into the trap or traps. In some prior art trap primers in which water is in contact with the compressed air, there is a tendency for the air to dissolve into the water, thereby reducing the volume of compressed air with an increase in the volume of water in the air chamber, until the primer fails to function properly. In other prior art primers, the compressed air is separated from the water by a moving piston. Such arrangements are susceptible to binding and malfunction of the moving parts due to water borne residues and corrosion of the parts.

In embodiments of the present disclosure, compressed gas in closed-cell polymeric foam, in combination with an anti-oscillation valve, is used to open a membrane valve in response to fluctuation of water supply pressure. Embodiments include an optional cleaning lever and probe. Embodiments include an optional distributor to serve a multiplicity of water traps. Embodiments provide trap primers which are reliable, inexpensive, and easy to manufacture.

Embodiments include a trap primer for maintaining water levels in a drain trap in a building having a water supply line comprising a connection to the building water supply line, an upper chamber, an anti-oscillating valve located between the supply line and the upper chamber. a lower chamber having a bottom and a circumferential upper edge, the upper and lower chambers separated by a flexible diaphragm, a valve stem extending vertically from the bottom to the upper edge of the lower chamber, the valve stem having a bore with an orifice at the upper end, and a port leading to a trap at the lower end, the diaphragm reversibly sealing the valve stem orifice, and a closed-cell polymeric foam medium, the cells containing a gas, the foam medium located in the lower chamber.

The following embodiments and aspects thereof are described and illustrated in conjunction with systems, tools and methods that are meant to be exemplary and illustrative, not limiting in scope. In various embodiments, one or more of the above described problems have been reduced or eliminated, while other embodiments are directed to other improvements.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

In this disclosure, the term "resilient gas enclosure" (RGE) means material manufactured of a resilient polymer containing a gas. When the RGE takes the form of a foam, such materials comprise independent, non-communicating cells of a resilient polymeric material, such as a polyurethane, polyvinyl chloride, polystyrene, polyimide, silicone or nitrile butadiene rubber (NBR). When the RGE takes the form of a foam, cells in the foam are formed during manufacturing using blowing agents, such as $CO_2$, $N_2$, or air. A suitable RGE closed-cell polymer foam is polyurethane with closed cells containing $CO_2$ gas. In some embodiments, the RGE takes the form of a hollow, gas containing sealed structure with impermeable resilient walls made of suitable polymers, such as those listed above, and containing a gas or gasses as described above. Such an embodiment is termed a "bubble chamber".

Figure 1:
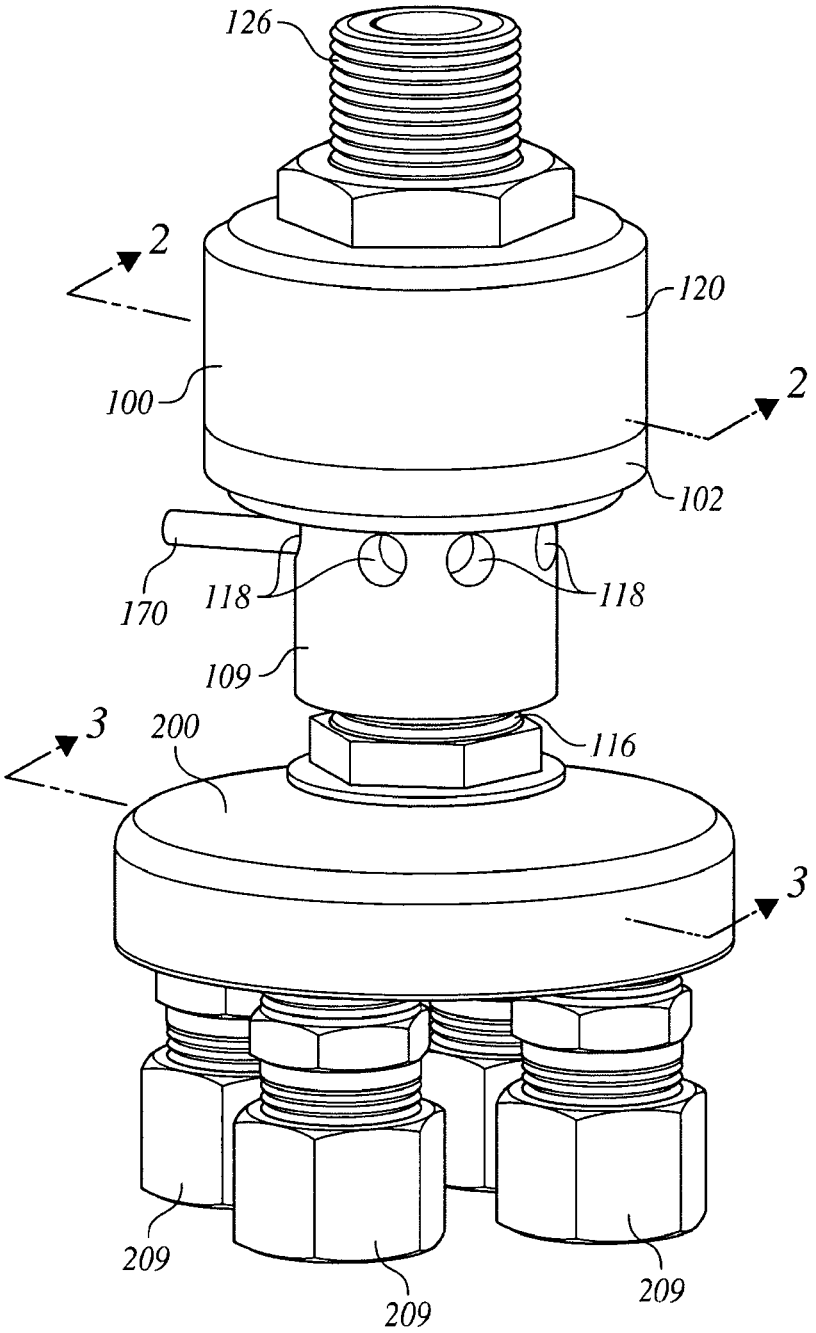
FIG. 1 is a perspective view of a trap primer with an attached optional outlet distributor.

FIG. 1 is a perspective view of a cylindrical trap primer 100 with an optional attached cylindrical outlet distributor 200. An inlet 126 is provided for attachment to the building water supply pipe (not shown in FIG. 1). The inlet is attached to an upper body 120, which is removeably attached to a lower body 102. Vent holes 118 are arrayed about a lower body neck 109. An optional cleaning lever 170, which extends through a vent hole 118 is visible in FIG. 1. An outlet 116 is provided at the bottom of the neck 109. The optional outlet distributor 200 is attached to the outlet 116. The distributor 200 may include a multiplicity of trap supply outlets 209 that connect pipes used to supply water to a multiplicity of traps (not show in FIG. 1).

Figure 2:
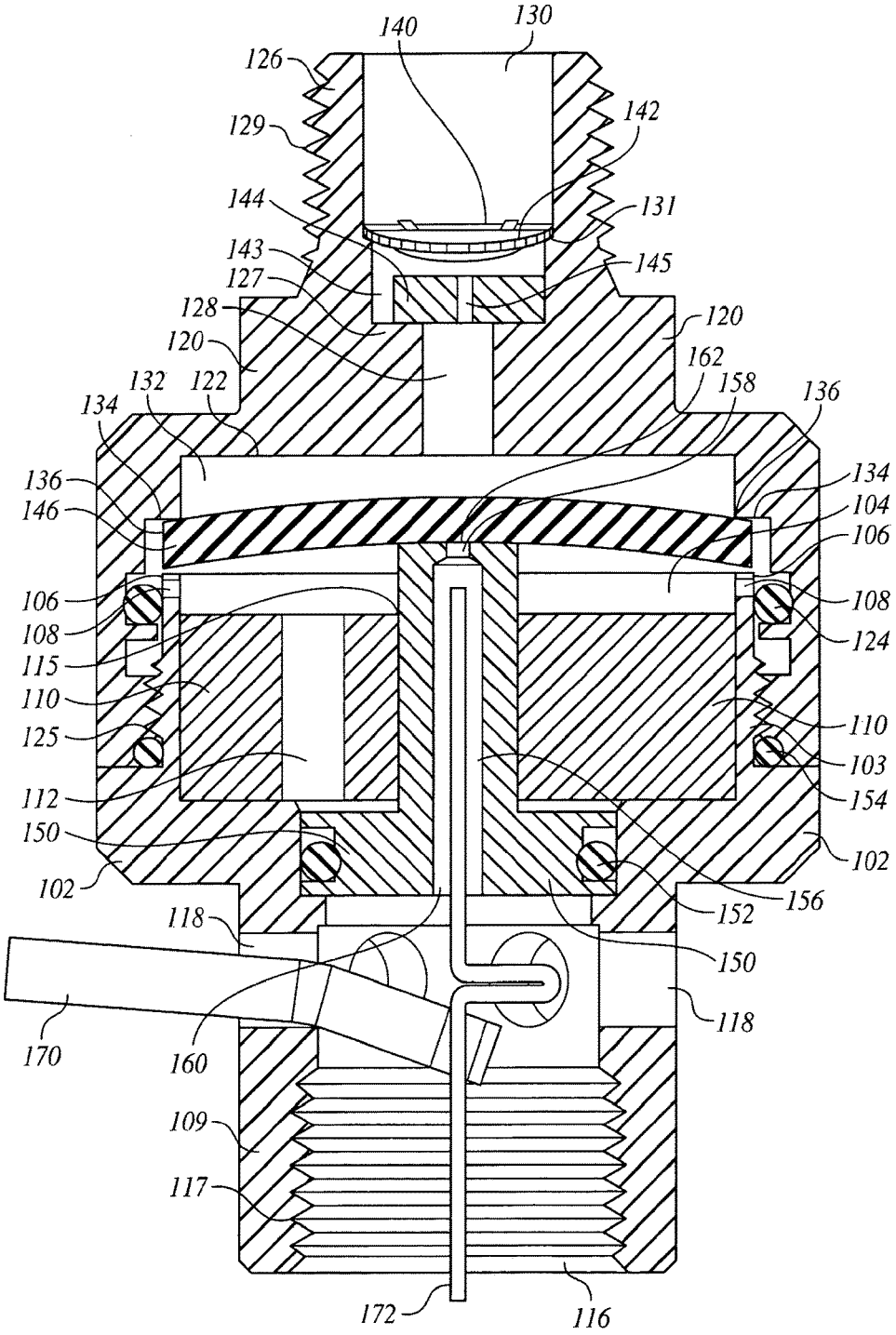
FIG. 2 is a cross-sectional view of the trap primer of FIG. 1 generally taken at line 2-2.

FIG. 2 is a cross-sectional view of the trap primer of FIG. 1 taken at line 2-2. Visible in FIG. 2 is the cylindrical upper body inlet 126 with external screw connector or threads 129 for connection to a water supply pipe (not shown in FIG. 2) and an inlet bore 130 for the passage of water into the trap primer. A circular disk-like filter 142 rests on a circular bore shoulder 131 in the inlet bore 130 and is held in place by a filter retainer 140. A disk-like anti-oscillation valve disc 144, with a valve disc center orifice 145, rests on an inlet shoulder 127. The combination of inlet bore 130, inlet bore shoulder 131, filter screen 142, filter retainer 140 and anti-oscillation valve disc 144 is referred to as an anti-oscillation valve 143.

The inlet 126 is attached to the cylindrical upper body 120. The inlet bore 130 leads to the upper body bore 128. The upper body bore 128 penetrates the center of the circular flat upper chamber ceiling 122. Flow of water into the upper body bore 128 is controlled by the check valve bore 145. The upper body bore 128 leads to a cylindrical upper chamber 132. There is a circumferential upper body shoulder 134 which runs around the upper chamber 132. A circular disk-like flexible diaphragm 146 is located below the upper body shoulder 134. An inlet check valve 136 is formed when the upper edges of the diaphragm 146 are pressed against the upper body shoulder 134. A lower chamber 104 is located below the diaphragm 146.

The upper body 120 is reversibly and releasably connected to the lower body 102 by screw threads 125 and 103, respectively. A first embodiment RGE, made of a closed-cell polymeric medium and termed a foam ring 110, rests in the lower chamber 104. A center hole 115 extends through the center of the foam ring 110. The valve stem 150 protrudes through the center hole 115. A multiplicity of foam ring holes 112 penetrate the foam ring 110. The circular lower chamber rim 106 is located at the top of the lower body 102. A multiplicity of holes 108 are arrayed below the lower chamber rim 106. Additional details on the lower chamber rim are found in FIG. 9. A valve stem 150 extends through the lower chamber 104 and is attached to the lower body 102. A valve stem bore 156 extends through the valve stem 150 with the valve stem orifice 158 at the upper end of the bore 156 and valve stem port 160 at the lower end of the bore 156. The diaphragm 146 reversibly blocks the valve stem orifice 158 forming the trap primer outlet valve 162.

A lower body neck 109 is attached to the bottom of the lower body 102. A multiplicity of vent holes 118 are arrayed about the lower body neck 109. The vent holes 118 act as vacuum breakers which prevent backflow of water from an outlet distributor or trap pipe and allow observation of the flow of water from the valve stem port 160. An outlet bore 116 receives water from the valve stem port 160. Screw threads 117 on the interior of the outlet bore 116 are used for reversible connection with an optional outlet distributor (see FIG. 3) or with a pipe leading to an individual trap. FIG. 2 shows the optional cleaning lever 170 which is attached to the optional cleaning probe 172 which extends through the valve stem bore 156 up to the valve stem orifice 158.

Figure 3:
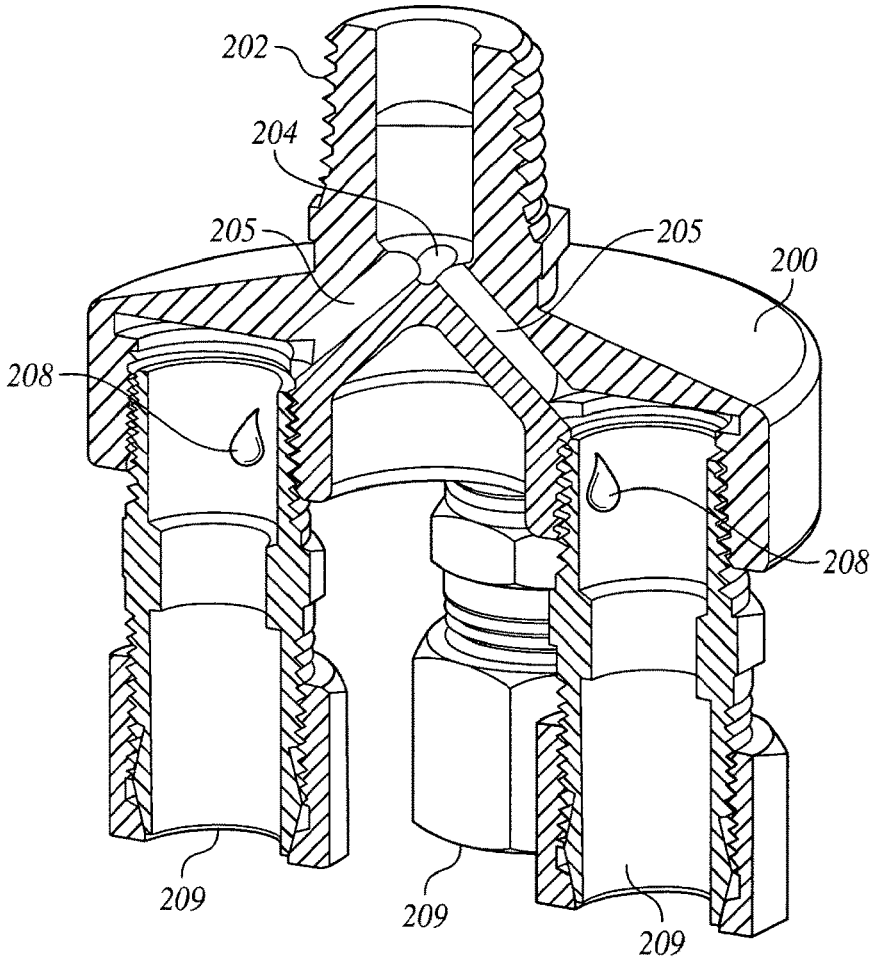
FIG. 3 is a cross-sectional view of the outlet distributor of FIG. 1 taken at line 3-3.

FIG. 3 is a cross-sectional view of the optional outlet distributor 200 of FIG. 1 taken at line 3-3. The distributor inlet 202 receives water from the outlet of the trap primer (not shown in FIG. 3). The flow of water enters the flow divider 204 where the flow is divided into each of a multiplicity of distributor bores (four bores in the embodiment of FIG. 3) and the flow 208 descends into the trap supply outlets 209. Pipes connected to the outlets lead to the individual traps which are served by the trap primer (not shown in FIG. 3).

Figure 4:
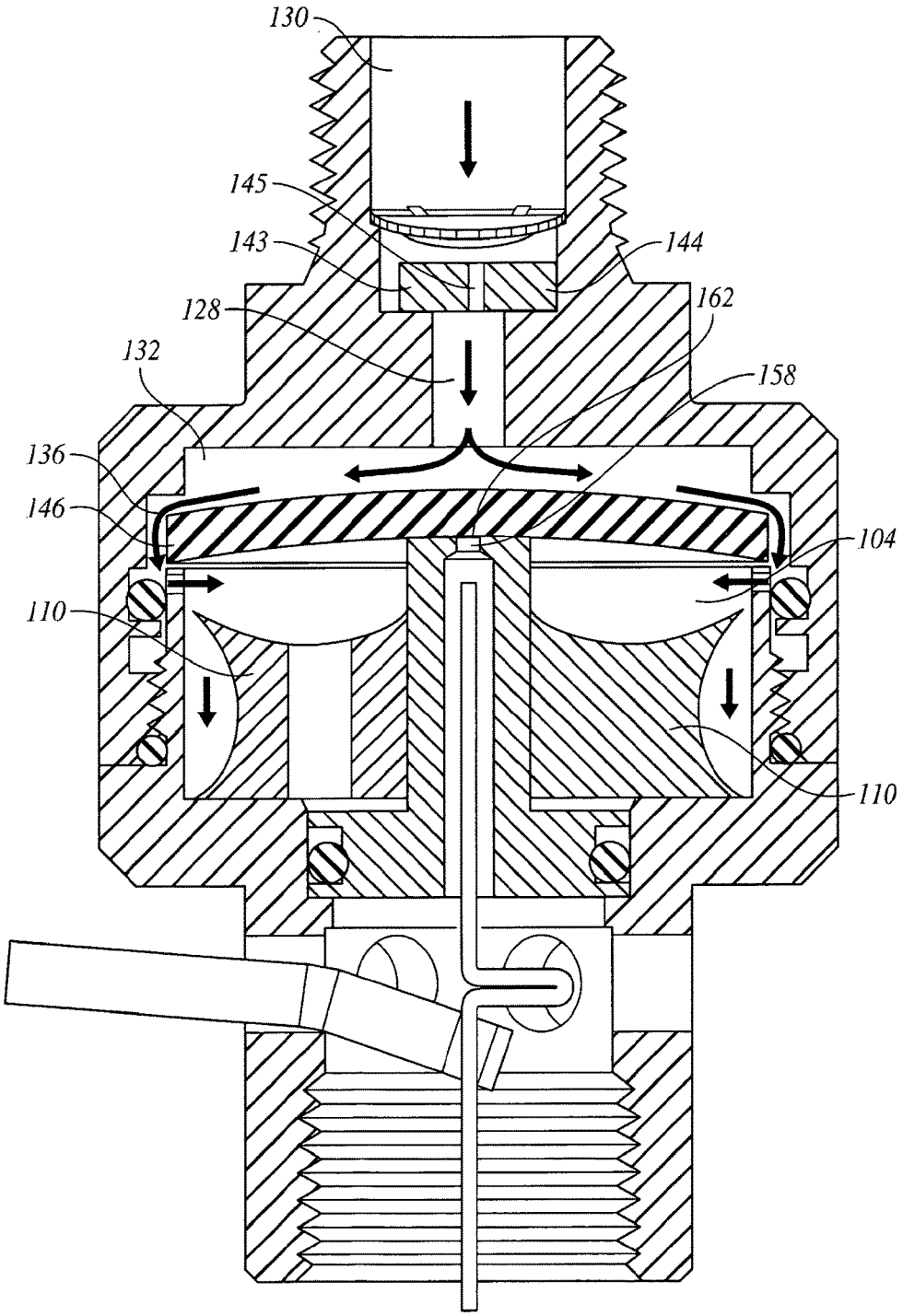
FIG. 4 is a cross-sectional view of the trap primer of FIG. 1 generally taken at line 2-2 and showing the start-up of the trap primer.

FIG. 4 is a cross-sectional view of the trap primer 100 of FIG. 1 taken at line 2-2. FIG. 4 shows the start-up of the trap primer 100. The elements of FIG. 4 are the same as in FIG. 2. The flow of water is indicated by arrows. In start-up, water flows into the inlet bore 130 and through the center orifice 145 of the anti-oscillation valve disc 144. The anti-oscillation valve 143 under these conditions is termed "closed". The water passes through the upper body bore 128 and into the upper chamber 132. The pressure of the water at line pressure closes the trap primer outlet valve 162 by pressing the diaphragm 146 against the valve stem orifice 158. Water flows through the now open inlet check valve 136 and enters and fills the lower chamber 104. The line pressure of the water compresses the gas within the closed cells of the polymeric foam ring 110 thereby compressing and distorting the RGE foam ring itself until the pressure within the closed cells within the foam ring equilibrates with the pressure in the water supply line.

Figure 5:
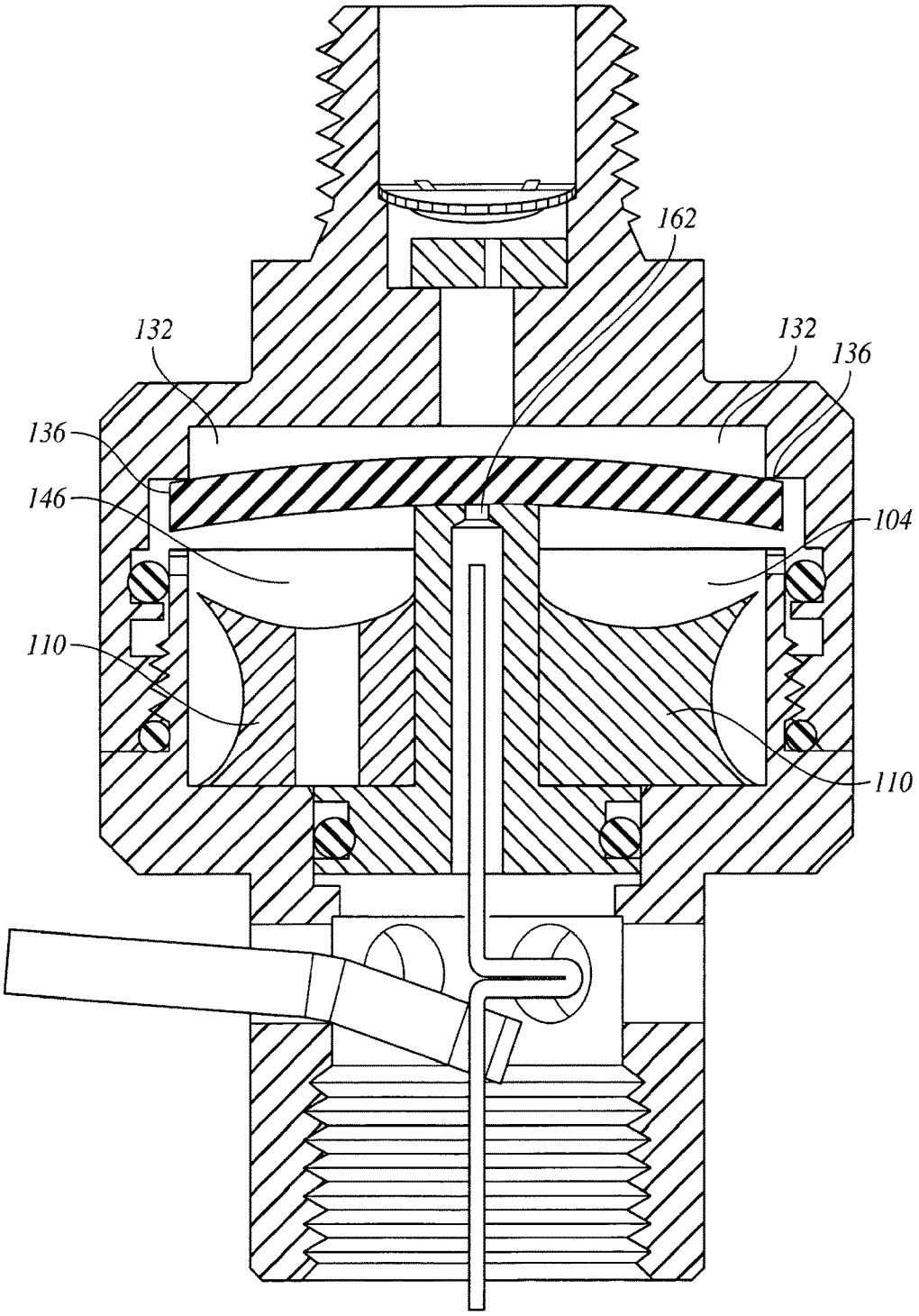
FIG. 5 is a cross-sectional view of the trap primer of FIG. 1 generally taken at line 2-2 and showing the trap primer under conditions of stable line pressure.

FIG. 5 is a cross-sectional view of the trap primer 100 of FIG. 1 taken at line 2-2. FIG. 5 shows the trap primer 100 under conditions of stable line pressure. The elements of FIG. 5 are the same as in FIG. 2. Note that the inlet check valve 136 is now closed, as is the trap primer outlet valve 162. The water pressures in both the upper 132 and the lower 104 chambers are the same. The gas pressure within the closed cells of the RGE polymeric foam medium or foam ring 110 is equilibrated at the same pressure as that of the water in the upper 132 and lower 104 chambers. There is no flow in or out of the trap primer 100. It should be noted that the trap primer outlet valve 162 opens and closes after a reduction in line pressure and before the increase in pressure to the start-up condition. The trap primer outlet valve 162 will react to a further drop in pressure by opening and closing, even if the original line pressure is not yet restored. Also, the inlet check valve 136 will react to a further increase in line pressure by opening and then closing, which will further result in additional compressing of the RGE polymeric foam medium or foam ring 110.

Figure 6:
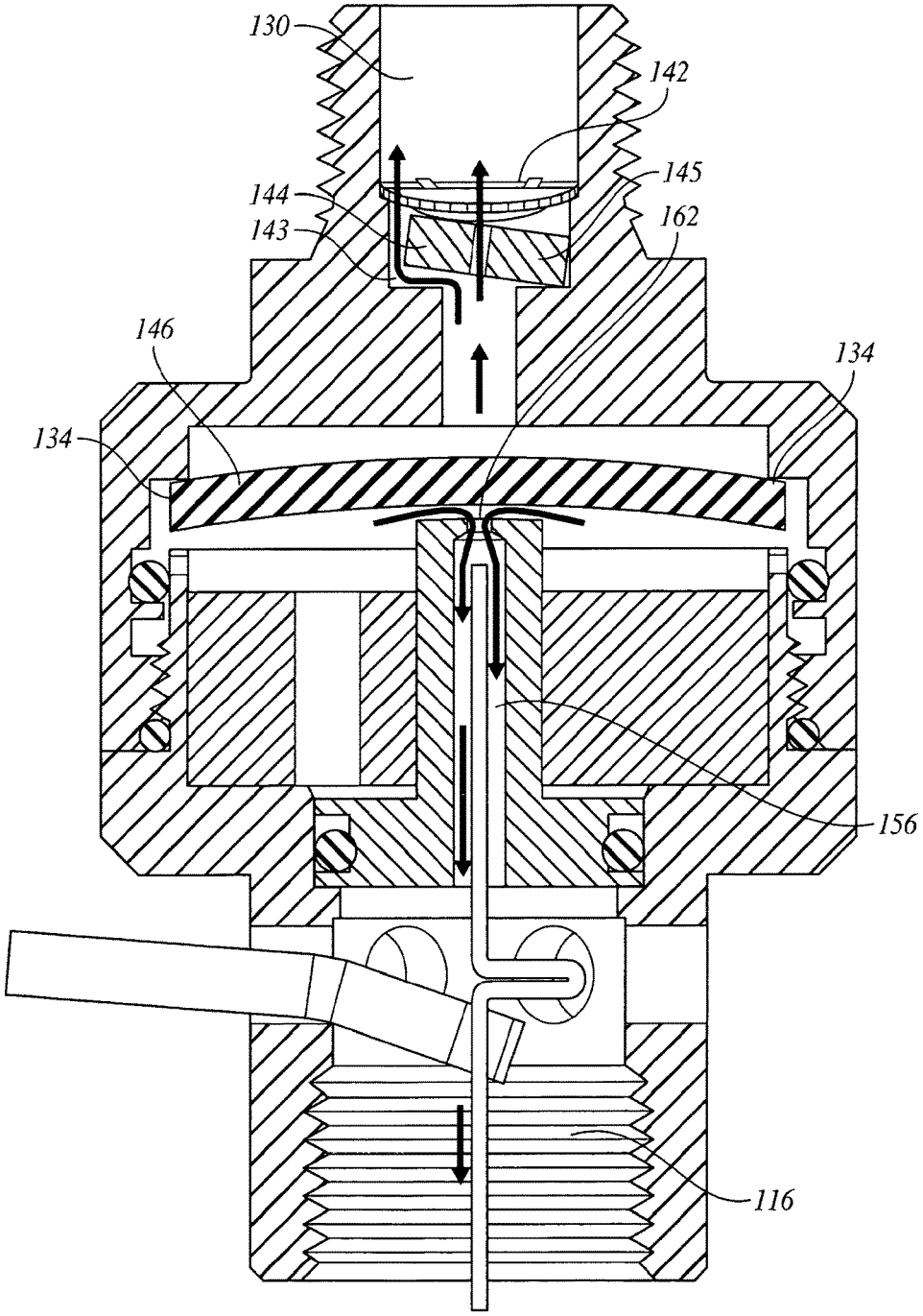
FIG. 6 is a cross-sectional view of the trap primer of FIG. 1 generally taken at line 2-2 and showing the behavior of the trap primer when there is a decrease in the line pressure.

FIG. 6 is a cross-sectional view of the trap primer 100 of FIG. 1 taken at line 2-2. FIG. 6 shows the behavior of the trap primer 100 when there is a decrease in the line pressure.

The elements of FIG. 6 are the same as in FIG. 2. Flow from the trap primer 100 is activated by a decrease in line water pressure, as accompanies the opening of a faucet or the flushing of a toilet. When the pressure drops, water flows from the upper chamber 132 through the anti-oscillation valve 143 into the inlet bore 130. Such flow is through the anti-oscillation valve disc orifice 145 and around one edge of a tilted anti-oscillation valve disc 144. The filter screen 142 prevents the anti-oscillation valve disc 144 from being pushed by the flow of water out of the trap primer 100 into the water supply pipe. Such flow develops because the pressure in the lower chamber, at the previously high level, causes flexing of the diaphragm 146 with simultaneous closing the inlet check valve 134, thereby maintaining separation of water between the upper and lower chambers by the diaphragm 146. Simultaneously with the flexing of the diaphragm 146 is the opening of the trap primer outlet valve 162, allowing the flow of water through the valve stem bore 156 into the outlet bore 116 and ultimately to the trap or traps. The impetus for the flexing of the diaphragm 146 is the gas within the closed pores of the RGE foam ring 110, which was previously equilibrated at the relatively higher line pressure. The distortion of the ring 110 is relieved as the pressure of the gas within the closed pores reaches the new lower pressure of the supply line. The resumption of the original volume of the foam ring 110 accompanies and is the impetus for the flow of water from the trap primer 100. When the faucet is closed or water closet replenished the higher pressure in the water supply line is reestablished and the start-up condition show in FIG. 4 is assumed.

It should be noted that the anti-oscillation valve disc 144 allows flow through the anti-oscillation valve disc center orifice 145 only when water is flowing from the water supply line into the trap primer 100 (see FIG. 4). When water flow is reversed, from the trap primer 100 into the water supply line (see FIG. 6), there is flow both through the disc center orifice 145 and, because the valve tilts, around the side of the valve disc 144. The delay of water flow from the water supply through the anti-oscillation valve disc orifice 145 has the important effect of delaying the recompression of the RGE foam ring 110 for a fraction of a second. This prevents trap primer oscillation due to water hammer effect. In the absence of an anti-oscillation valve disc 144 the trap primer 100 has a tendency to oscillate from the open to the closed mode. This anti-oscillation valve design allows very low pressure drop sensitivity in the trap primer valve design, observed to be as low as 0.25 psi.

Figure 7:
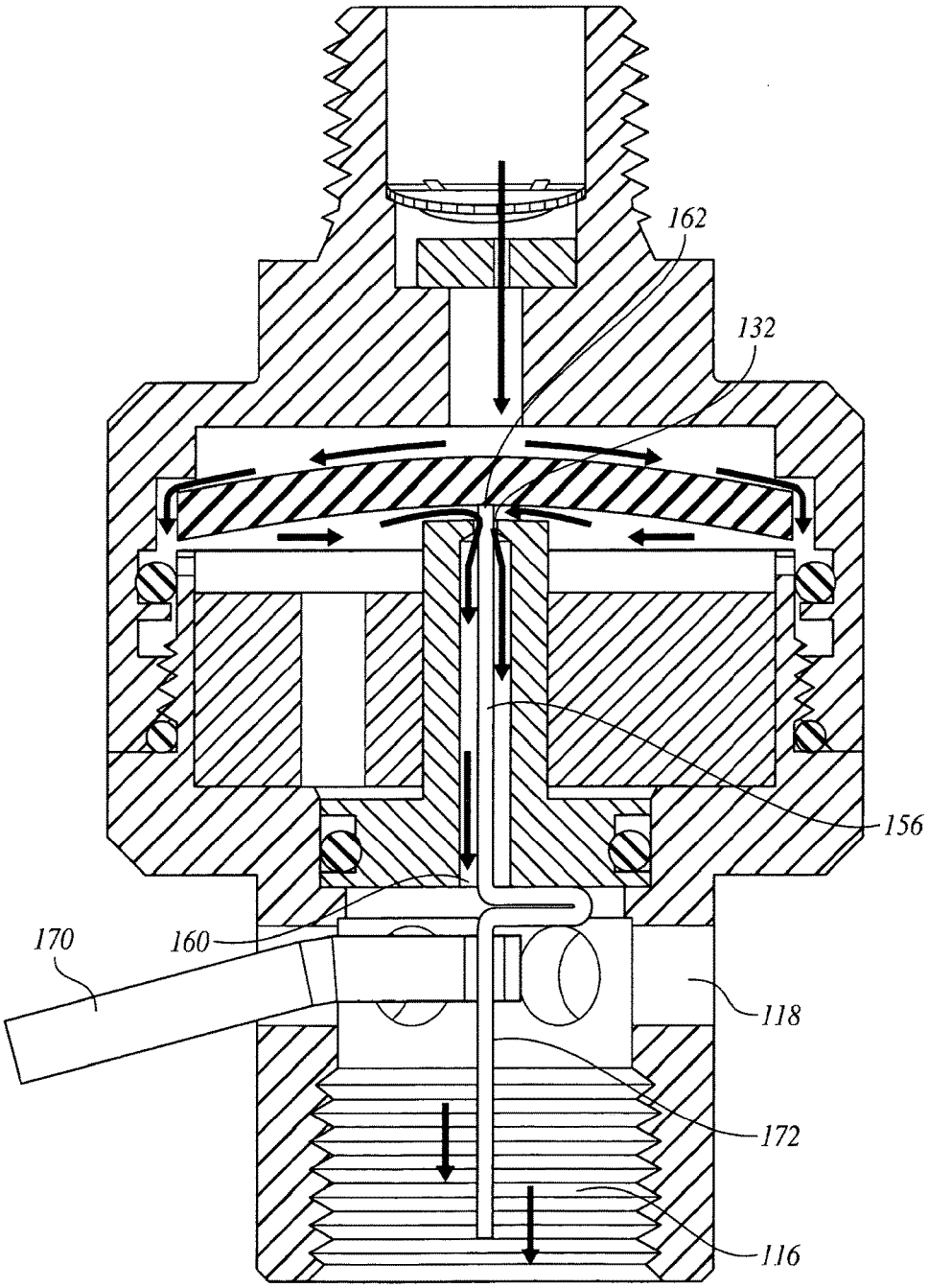
FIG. 7 is a cross-sectional view of the trap primer of FIG. 1 generally taken at line 2-2 and showing the action of the cleaning lever and probe.

FIG. 7 is a cross-sectional view of the trap primer of FIG. 1 taken at line 2-2 with the cleaning lever and probe and showing the action of the cleaning lever and probe. The elements of FIG. 7 are the same as in FIG. 2. Pressing down on the cleaning lever 170 raises the probe 172 thereby cleaning the valve stem bore 156 and valve stem orifice 158. Raising the probe 172 also opens the trap primer outlet valve 162 allowing water to flow through the valve stem orifice 158, into the valve stem bore 156, out the valve stem port 160, and through the outlet bore 116 thereby simulating the function of the trap primer 100 under conditions of reduced line pressure. The flow of water from the valve stem port 160 can be observed through a vent hole 118, allowing confirmation of the proper function of the trap primer. In some embodiments, flow from the trap primer is about 4.2 ounces per minute. Lowering the probe 172 allows flow in the start-up condition to resume as shown in FIG. 4.

Figure 8:
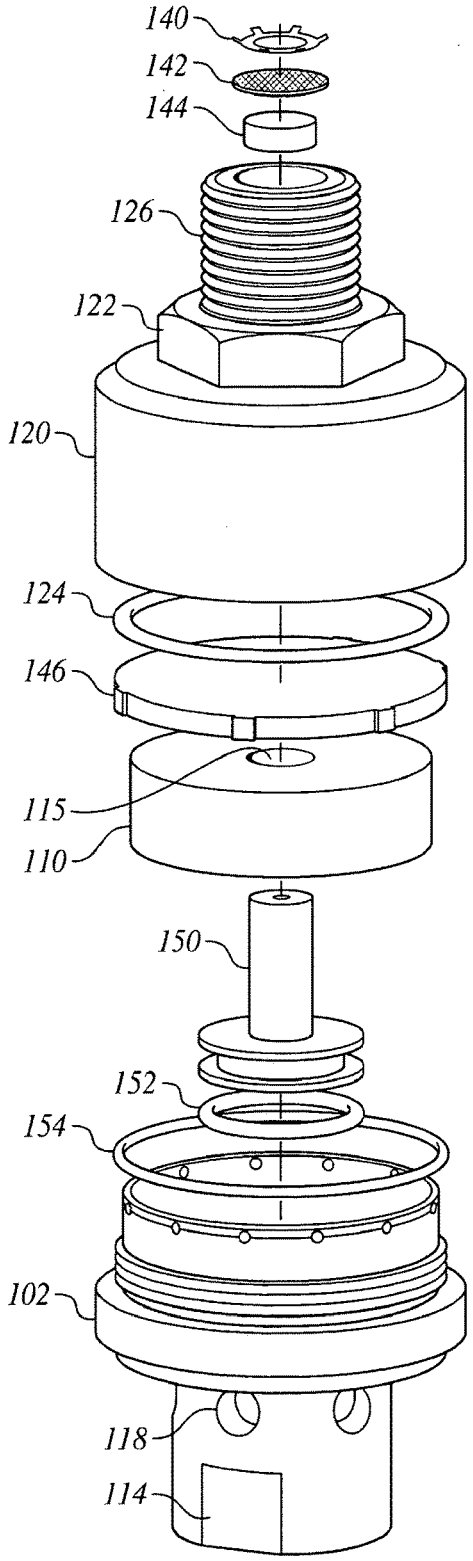
FIG. 8 is an exploded view of the components of the trap primer without the cleaning lever and probe.

FIG. 8 is an exploded view of the components of an embodiment trap primer. Visible in FIG. 8 is the filter retainer 140 which holds the filter screen 142 in place within the upper body inlet 126. Also visible is the wrench hex 122 on the upper body 120. Also visible is the upper body o-ring 124, diaphragm 146, and the RGE closed-cellular polymer foam ring 110 with center hole 115. Also visible is the valve stem 150, valve stem o-ring 152, and lower body o-ring 154. Also visible is the lower body 102, lower body vent holes 118, and lower body wrench flat 114.

Figure 9:
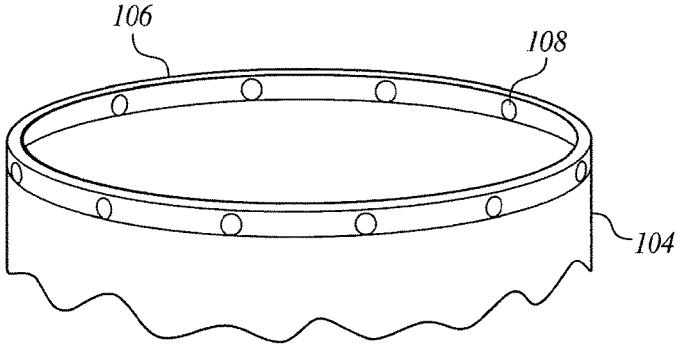
FIG. 9 is a perspective view of a rim of the lower chamber of the trap primer.

FIG. 9 is a perspective view of the rim 106 of the lower chamber 104 of the trap primer 100. Visible in FIG. 9 is the cylindrical lower chamber 104, the lower chamber rim 106 at the top of the lower chamber, and the multiple lower chamber rim openings 108, which are arrayed about the circumference of the rim 106.

Figure 10:
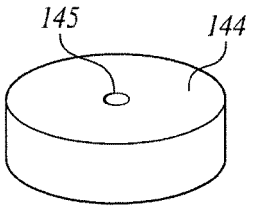
FIG. 10 is a perspective view of the anti-oscillation valve disk.

FIG. 10 is a perspective view of the anti-oscillation valve disc 144. Visible in FIG. 10 is the disc 144 itself and the center orifice 145.

Figure 11:
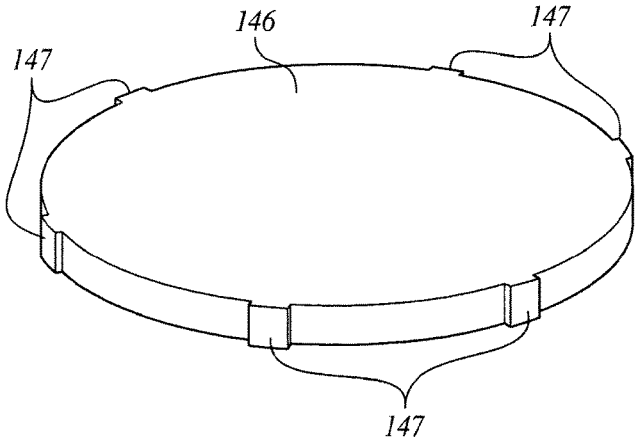
FIG. 11 is a perspective view of the flexible diaphragm.

FIG. 11 is a perspective view of the flexible diaphragm 146. Visible in FIG. 11 are a multiplicity of diaphragm centering tabs 147. In the embodiments hereof, six centering tabs 147 are arrayed about the circumference of the diaphragm 146. The centering tabs 147, however, are optional.

Figure 12:
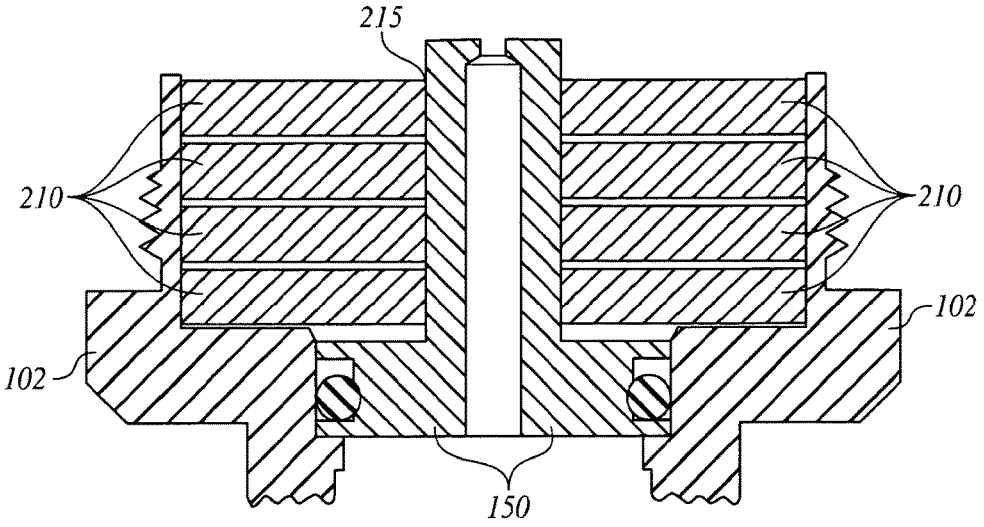
FIG. 12 is cross-sectional view of the trap primer of FIG. 1 generally taken at line 2-2 and showing a second embodiment of a foam medium or foam disk located in the lower chamber.

FIG. 12 is cross-sectional view of the trap primer 100 of FIG. 1 generally taken at line 2-2 and showing a second embodiment RGE polymeric foam medium, or foam discs 210, located in the lower chamber 102. The second embodiment polymeric foam medium or foam discs 210 is a multiplicity of stacked a circular discs 210 each cooperating to define a center hole 215. Each foam disc 210 of the second embodiment is thinner than the first embodiment foam ring 110. The valve stem 150 protrudes through the center hole 215 when the foam discs 210 are installed. In embodiments, four foam discs 210 are placed in the lower chamber. The second embodiment polymeric medium is identical to the first embodiment in performance and material of manufacture.

Figure 13:
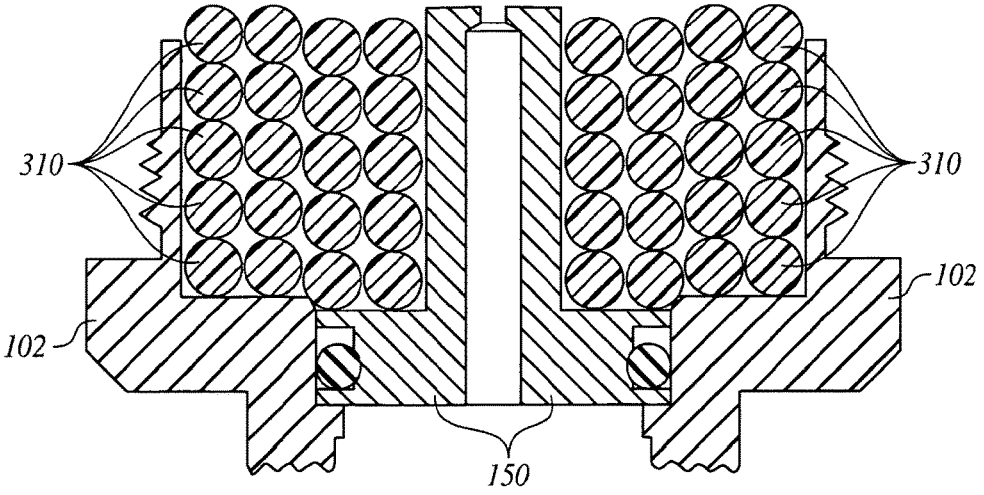
FIG. 13 is cross-sectional view of the trap primer of FIG. 1 generally taken at line 2-2 and showing a third embodiment of a foam medium or foam particles located in the lower chamber.

FIG. 13 is cross-sectional view of the trap primer 100 of FIG. 1 generally taken at line 2-2 showing a third embodiment RGE polymeric foam medium, or foam particles 310, located in the lower chamber 102. The foam particles 310 have a generally spherical form. In embodiments the diameter of the particles 310 have a diameter of approximately 0.25 to 0.5 inches. The third embodiment polymeric medium is identical to the first embodiment in performance and material of manufacture.

Figure 14:
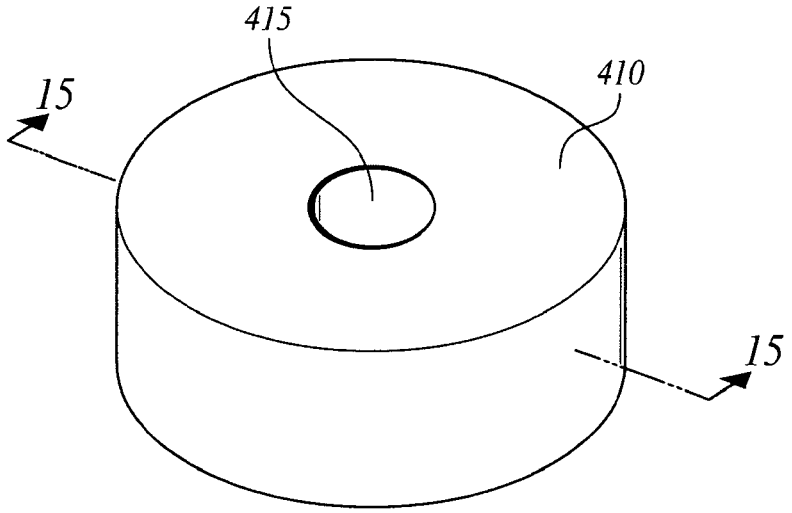
FIG. 14 is a perspective view of a fourth embodiment of a resilient gas enclosure or bubble chamber.

FIG. 14 is a perspective view of a fourth embodiment RGE or bubble chamber 410. The bubble chamber 410 generally has a donut-shape with a center hole 415. The bubble chamber 410 can be constructed from a variety of materials, one illustrative material being a butyl type rubber, such as isobutylene isoprene rubber.

Figure 15:
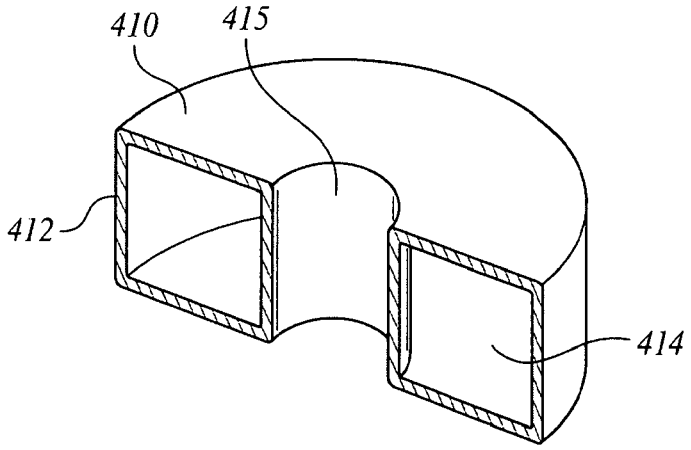
FIG. 15 is a cross sectional view of the fourth embodiment resilient gas enclosure or bubble chamber generally taken at line 15-15 of FIG. 14.

FIG. 15 is a cross sectional view of the fourth embodiment RGE or bubble chamber 410 generally taken at line 15-15 of FIG. 14. Visible in FIG. 15 is the chamber wall 412 and chamber lumen 414. The bubble chamber takes the form of a hollow, gas containing sealed structure with impermeable resilient walls made of suitable polymers, such as polyurethane, polyvinyl chloride, polystyrene, polyimide, or silicone and containing in the lumen 414 a gas or gasses such as $CO_2$, $N_2$, or air.

Figure 16:
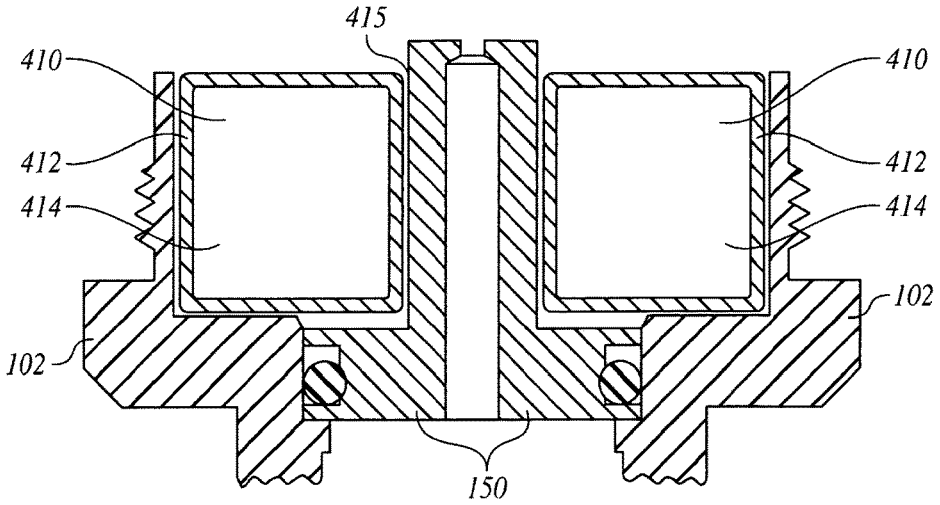
FIG. 16 is a cross-sectional view of the trap primer of FIG. 1 generally taken at line 2-2 showing the fourth embodiment of the resilient gas enclosure or bubble chamber located in the lower chamber.

FIG. 16 is a cross-sectional view of the trap primer 100 of FIG. 1 generally taken at line 2-2 showing the fourth embodiment RGE or bubble chamber 410 located in the lower chamber 102. The fourth embodiment RGE or bubble chamber 410 is shaped like a circular disk with a center hole 415. The valve stem 150 protrudes through the center hole 415 when the bubble chamber 410 is installed. Also visible in FIG. 16 is the bubble chamber wall 412 and bubble chamber lumen 414.

Figure 17:
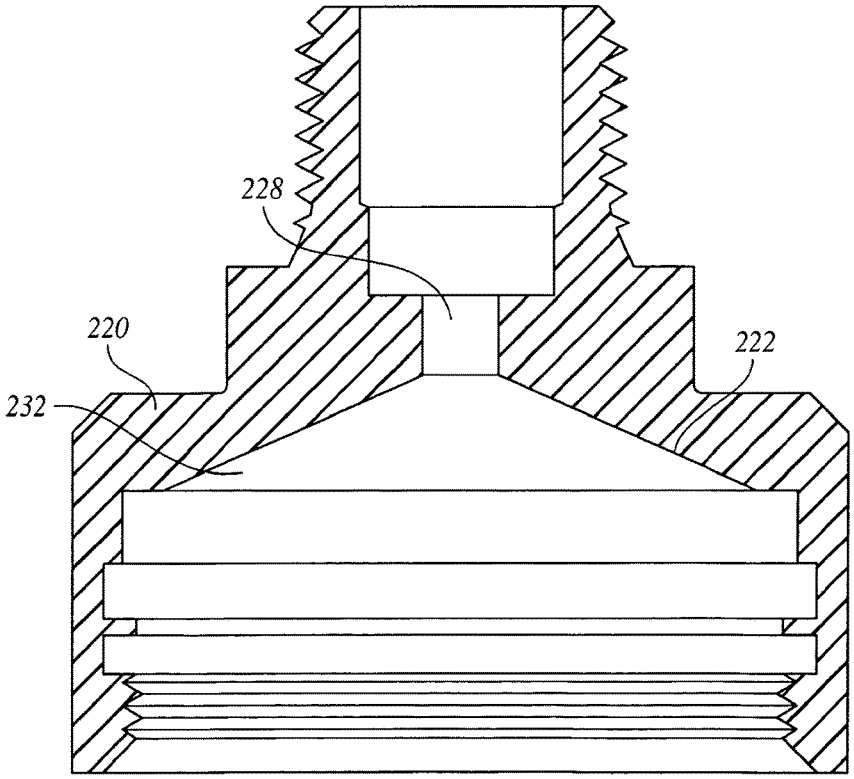
FIG. 17 is a cross-sectional view of a second embodiment of the upper body of the trap primer.

FIG. 17 is a cross-sectional view of a second embodiment of the upper body 220. The second embodiment upper body 220 is identical to the first embodiment upper body 120 with the exception of the upper chamber ceiling 222. In the first embodiment upper body (as in FIG. 2) the upper chamber ceiling 122 is flat. In the second embodiment upper body 220, shown in cross-section in FIG. 17, the upper chamber ceiling 222 slopes upwardly toward the upper body bore 228. The second embodiment upper chamber 232 therefore has the form of a cylinder topped by a cone with straight sides. The second embodiment upper body chamber 232 is more sensitive to fluctuations in water pressure than the first embodiment upper body chamber. The second embodiment is particularly suitable for use in installations with relatively low water pressure changes or drops.

The polymeric foam medium in all RGE embodiments, except the fourth embodiment, is manufactured of a closed-cell polymer foam. Such materials comprise independent, non-communicating cells of a resilient polymeric material, such as a polyurethane, polyvinyl chloride, polystyrene, polyimide, or silicone. Cells in the foam are formed during manufacturing using blowing agents, such as $CO_2$, $N_2$, or air. A suitable closed-cell polymer foam is polyurethane with closed cells containing $CO_2$ gas.

The wall material of the fourth embodiments RGE is manufactured of polymers such as polyurethane, polyvinyl chloride, polystyrene, polyimide, or silicone. The gas or gasses of the fourth embodiment RGE is a gas such as $CO_2$, $N_2$, or air.

While the RGE of all embodiments may be thought of as a sealed chamber of gas or gasses, it should be noted that it can float freely and, unlike pistons, functions while producing little or no friction. No O-rings or other sealing devices are required. The polymeric foam medium embodiments and the bubble chamber embodiment responds very quickly to any positive or negative changes in inlet pressure. The trap primer 100 has been shown to respond to a pressure drop of less than 0.25 psi.

In embodiments, both the anti-oscillation valve disc 144 and the flexible diaphragm 146 are manufactured of any suitable relatively light, rigid, strong water-resistant material such as ethylene propylene diene monomer (M-class) rubber, a synthetic rubber also called EPDM rubber.

Solid parts of the trap primer 100 are manufactured of any suitable strong, corrosion-resistant material, such as steel, stainless steel, brass, bronze, copper alloys and plastics. In embodiments the valve stem is made of brass.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

What is claimed is:

1. A trap primer for maintaining water levels in a drain trap in a building having a building water supply line, the trap primer comprising:

a supply line connection configured for coupling to the building water supply line;

an anti-oscillation valve comprising:

a body having a water supply bore provided therethrough, the bore including portions defining an inlet and an outlet, the inlet being coupled to the supply line connection;

a first bore shoulder formed in the bore;

a filter screen retained engaged on the first bore shoulder;

a second bore shoulder formed in the bore;

an anti-oscillation valve disc freely resting on the second bore shoulder, the anti-oscillation valve disc having a valve disc orifice defined therethrough and communicating the inlet with the outlet; and the anti-oscillation valve disc being retained between the first bore shoulder and the second bore shoulder; and a chamber coupled to the outlet of the anti-oscillation valve;

a valve located in the chamber, the valve being moveable between a first position preventing water flow to the drain trap and a second position permitting water to flow to the drain trap.

2. The trap primer of claim 1, wherein the anti-oscillation valve disc is retained between the filter screen and the second bore shoulder.

3. The trap primer of claim 1, wherein the first shoulder is formed in a portion of the bore having a first diameter and the second shoulder is formed in a portion of the bore having a second diameter.

4. The trap primer of claim 3, wherein the second diameter is less than the first diameter.

5. The trap primer of claim 4, wherein the anti-oscillation valve disc defines a disc diameter that is less than the second diameter.

6. The trap primer of claim 3, wherein the anti-oscillation valve disc is tiltable within the portion of the bore having the second diameter.

7. A trap primer for maintaining water levels in a drain trap in a building having a building water supply line, the trap primer comprising:

a supply line connection configured for coupling to the building water supply line, an anti-oscillation valve including a body having a water supply bore provided therethrough, the bore including portions defining an inlet and an outlet, the inlet being coupled to the supply line connection, a first bore shoulder formed in the bore, a filter screen engaged on the first bore shoulder, a second bore shoulder formed in the bore, an anti-oscillation valve disc freely resting on the second bore shoulder and being retained between the second bore shoulder and first bore shoulder, the anti-oscillation valve disc having a valve disc orifice defined therethrough and communicating the inlet with the outlet;

an upper chamber coupled to the outlet of the anti-oscillation valve;

a lower chamber having a bottom and a circumferential upper edge;

a flexible diaphragm separating the upper chamber from the lower chamber; and a valve stem extending within the lower chamber and including an inlet orifice coupled by a bore to port; and the diaphragm being moveable as a result of pressure differences in the upper and lower chambers between a position where the inlet orifice is closed off and a position where the inlet orifice is open allowing water to flow to the drain trap.

8. The trap primer of claim 7, wherein the anti-oscillation valve disc is retained between the filter screen and the second bore shoulder.

9. The anti-oscillation valve of claim 7, wherein the first shoulder is formed in a portion of the bore having a first diameter and the second shoulder is formed in a portion of the bore having a second diameter.

10. The anti-oscillation valve of claim 9, wherein the second diameter is less than the first diameter.

11. The anti-oscillation valve of claim 10, wherein the anti-oscillation valve disc defines a disc diameter that is less than the second diameter.

12. The anti-oscillation valve of claim 9, wherein the anti-oscillation valve disc is tiltable within the portion of the bore having the second diameter.

* * * * *